US006401254B1

(12) United States Patent
Boller

(10) Patent No.: US 6,401,254 B1
(45) Date of Patent: Jun. 11, 2002

(54) DEVICE FOR WEARING ON A HAND AND COUNTING AND DISPLAYING GOLF STROKES TAKEN PER HOLE PER GAME

(76) Inventor: David W. Boller, 278 1st Ave., Apt. 4H, New York, NY (US) 10009

( * ) Notice: Subject to any disclaimer, the term of this patent is extended or adjusted under 35 U.S.C. 154(b) by 0 days.

(21) Appl. No.: 09/966,295

(22) Filed: Sep. 28, 2001

(51) Int. Cl.[7] ..... A41D 19/00

(52) U.S. Cl. ..... 2/161.2; 2/160; 116/223; 473/205

(58) Field of Search ..... 2/16, 158, 159, 2/160, 161.1, 161.2; 116/222–225; 235/1 B, 104; 364/410.1, 411.1, 412.1; 368/3, 82, 84, 203, 205; 377/5; 473/199, 201, 202, 205, 406

(56) References Cited

U.S. PATENT DOCUMENTS

| | | | | | |
|---|---|---|---|---|---|
| 3,847,110 | A | * | 11/1974 | Inoue | 116/223 |
| 4,142,236 | A | | 2/1979 | Martz et al. | 364/411 |
| 4,367,526 | A | | 1/1983 | McGeary et al. | 364/411 |
| 4,557,215 | A | | 12/1985 | Petersson | 116/222 |
| 4,766,611 | A | * | 8/1988 | Kim | 2/160 |
| 4,864,592 | A | | 9/1989 | Lee | 377/5 |
| 4,922,850 | A | | 5/1990 | Conley | 116/222 |
| 5,353,439 | A | * | 10/1994 | Kurtz et al. | 2/160 |
| D353,110 | S | * | 12/1994 | Calabrese et al. | 235/104 |
| 5,509,809 | A | * | 4/1996 | Clay | 473/202 |
| 5,536,010 | A | | 7/1996 | Lambourne | 364/411 |
| 5,550,884 | A | | 8/1996 | Berney | 377/5 |
| 5,569,103 | A | * | 10/1996 | Sihn | 473/406 |
| 5,730,658 | A | | 3/1998 | Kurtz et al. | 473/205 |
| 5,771,492 | A | | 6/1998 | Cozza | 2/161.2 |
| 6,052,828 | A | * | 4/2000 | Widdemer | 2/159 |
| 6,181,648 | B1 | * | 1/2001 | Mafune et al. | 368/84 |

* cited by examiner

*Primary Examiner*—Danny Worrell
*Assistant Examiner*—Gary L. Welch
(74) *Attorney, Agent, or Firm*—Richard L. Miller

(57) ABSTRACT

A device that counts and displays golf strokes per hole and per game and includes a golf glove and a counter attached to the golf glove, either by hook and loop fasteners, snaps, a magnet, or a pouch. The counter includes a hole strokes digital counter and display for counting and displaying the golf strokes per hole, a total strokes digital counter and display for counting and displaying the golf strokes per game, a stroke advance button that advances the hole stroke counter and display and the total strokes digital counter and display, a clear button that clears the hole strokes digital counter and display, either an on/off button or a two second timer that allows the total strokes digital counter and display to be cleared when the clear button is depressed for two seconds, and a power source that is either a battery interface or a solar cell.

16 Claims, 2 Drawing Sheets

24
20
22
7,8,9,10,11
26
36
28
35
34
2,4,5,6
30
33
32

734
560,760
ON
OFF
TOTAL
CL
STROKES
+1

34
32
30
140
35
138
133
26

35
30
32
140
26
138
133
24

656
ON/OFF
634
TOTAL
CL
STROKES
+1
560,562
POWER SOURCE 560,860
834
TOTAL
CL
STROKES
+1

560,562
534
556
2 SEC TIMER
POWER SOURCE
550
+1
CL
554
STROKES
TOTAL
548
556
2 SEC TIMER
552

534
554
552
TOTAL
CL
565
POWER SOURCE
556
STROKES
+1
560,562
2 SEC TIMER 550
548

FIG.5
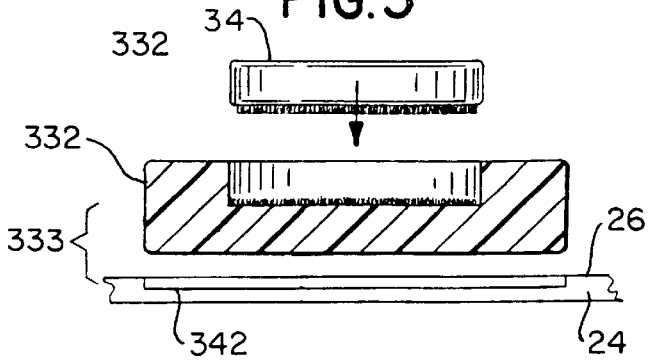
FIG. 4
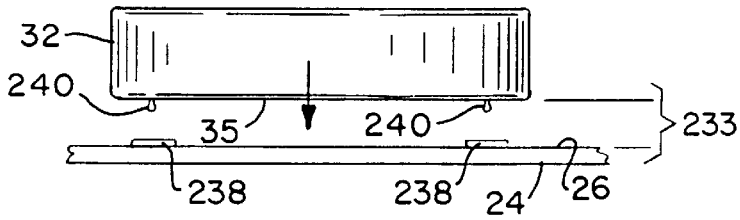
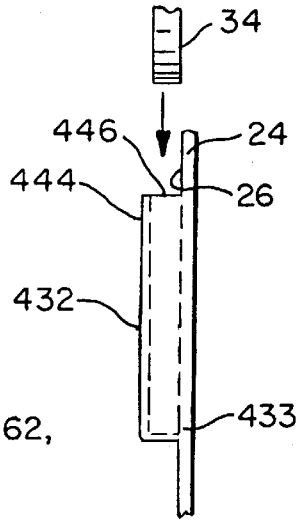
FIG.6
FIG.12
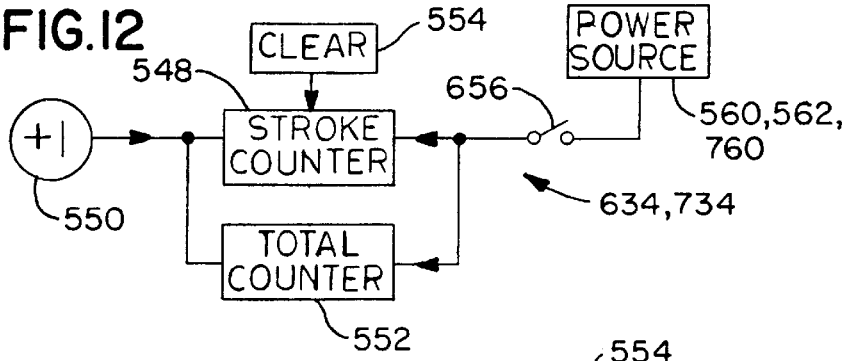
FIG.13
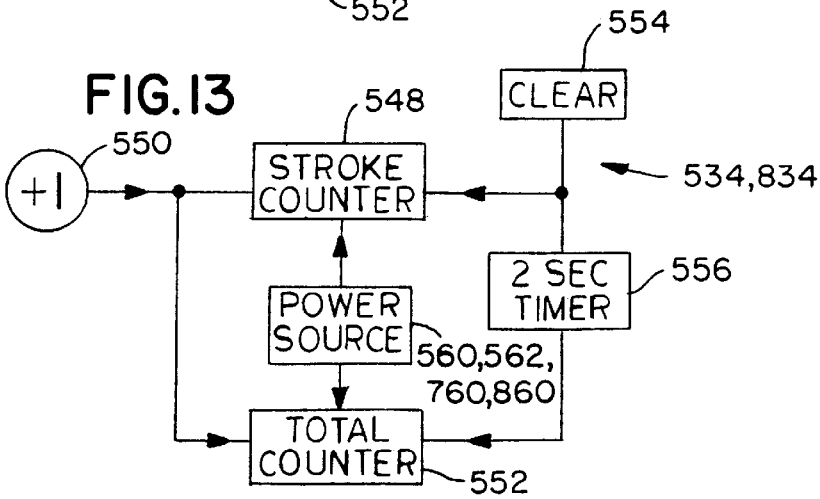

DEVICE FOR WEARING ON A HAND AND COUNTING AND DISPLAYING GOLF STROKES TAKEN PER HOLE PER GAME

CROSS REFERENCE TO RELATED APPLICATIONS

The instant application contains subject matter disclosed in applicant's Disclosure Document No. 478288 filed on Aug. 14, 2000. And as such, it is respectfully requested in a separate paper attached herewith that this Disclosure Document be relied upon and remain a permanent part of the file history during the prosecution of the instant application and during any subsequent action thereof.

BACKGROUND OF THE INVENTION

1. Field of the Invention

The present invention relates to a device for wearing in a hand and counting and displaying. More particularly, the-present invention relates to a device for wearing on a hand and counting and displaying golf strokes taken per hole and per game.

2. Description of the Prior Art

Numerous innovations for golf score counters have been provided in the prior art that will be described. Even though these innovations may be suitable for the specific individual purposes to which they address, however, they differ from the present invention.

A first example, U.S. Pat. No. 4,142,236 to Martz et al. teaches an electronic scorecard for golf that includes a keyboard having keys or switches representative of the digits 0–9 and commands. A preprogrammed microprocessor is responsive to manipulation of the keyboard to store in memory golf course date and player scoring data for multiple players. Appropriate manipulation of the keyboard commands the microprocessor to perform arithmetic operations on certain of said data. A display connected to the microprocessor visually presents the desired data or results individual to each player for comparison during the game.

A second example, U.S. Pat. No. 4,367,526 to McGeary et al. teaches an electric calculator for use in golf play and which includes a keyboard providing a number of keys or switches representative of digits and commands. A preprogrammed microprocessor functions in combination with the keyboard and memory means to store various data on players, courses, and contest arrangements for the players. Further manipulation of the keys provides commands to the microprocessor for performing predetermined computations on the date, and a display receives the results to indicate the scores and results of specified contests between individual players both during the game and at its conclusion.

A third example, U.S. Pat. No. 4,557,215 to Petersson teaches a counting device to indicate a current score and intended to be worn by an individual participating in a sport. The device comprises annular indicator organs provided with symbols to indicate the score and an organ with a read-off point. The indicator organs can be moved in relation to the read-off point so that different symbols can be advanced to that position. The main part of the device consists of soft, flexible material, preferably being some form of textile material. The device thus forms a soft, flexible, annular loop having a circumference such that it may be worn around the wrist, for example.

A fourth example, U.S. Pat. No. 4,864,592 to Lee teaches an electronic golf score counter for counting each fairway and putting stroke and totaling hole scores, total scores for the front nine holes, totals for the second or back nine, and the 18-hole totals. The counter has LCD displays and a plurality of switch keys for entering and displaying the hole number, its par value, the tee and fairway and putting strokes for each hole, and their totals. A reverse feature permits a count-down to a selected hole for a review of correction of a score. One embodiment provides a count for four players land includes an over/under par displays for each.

A fifth example, U.S. Pat. No. 4,922,850 to Conley teaches a golf glove having a golf stroke counter mounted on the back thereof which includes a cursor, which is either a straight member or a dial which is retained within layers of material on the back of a golf glove and which can be moved to positions designating the specific number of strokes taken and which is frictionally engaged in such positions.

A six example, U.S. Pat. No. 5,536,010 to Lambourne teaches an electronic golf scorecard that has a casing which can be opened to expose a keypad and a display. The keypad can be used to enter players' initials, handicap data and each player's score on individual holes during a game of golf. Circuitry within the scorecard, processes and stores the entered data and displays appropriate information so that each player's score can be visually determined. The scorecard keeps a cumulative total of the players' scores after each score entry. When the game of golf has been completed, the net scores for all players are automatically calculated and are displayed by selecting the appropriate key on the keypad. Unused memory locations can be used to keep track of other golfing data such as for example, the number of putts per hole, the holes won or lost during the match or the stroke holes in the match, to name but a few. This other golfing data can be displayed by selecting appropriate keys on the keypad.

A seventh example, U.S. Pat. No. 5,550,884 to Berney teaches an analogue display golf counter that comprises a first example four hands independent of each other driven for four stepping motors. The position of the hands is controlled by an electronic system comprising counting, storing, processing and control means in response to programmed algorithms and to data introduced by means of two pushers. The first hand indicates the course position (hole), the second the operating mode, and the last two the number of points, one displaying the units with the sign and the other the tens. There are three operating modes, namely "simple total", "cumulative total" and "programming". In this latter mode, it is possible to program a standard course to which reference may be made.

An eight example, U.S. Pat. No. 5,730,658 to Kurtz et al. teaches a system for attaching a scoring display unit to a fastening band of a glove. The fastening band includes a top strap, and a back surface patch for the top strap. Confronting surfaces of the top strap and the back surface patch comprise cooperating interengaging means, such as hooks and loops of VELCRO fabric. The scoring device of the invention includes a rotary, numbered disc scoring device having protrusions around the periphery which are engaged by a finger to rotate the disc as each golf shot is taken. A scoring window in the front side permits viewing of the selected score number. A fabric hook strip is attached on each end of the scoring device, the unit is placed on the top side of the top strap, wrapped under the glove flap and the hook strip engages the loop fabric of the glove strap. The assembly is then placed over the top of a glove top strap and fastened to the loop VELCRO on the underside of the glove top strap.

A ninth example, U.S. Pat. No. 5,771,492 to Cozza teaches a golf training glove for emitting distinctive physically perceivable signals in response to a failure of a golfer to maintain a correct grip about a golf club during a golf swing. The basic glove is similar to a conventional golf glove with a hand access opening and plural finger stalls. A sensor is located in a region corresponding to the back of a golfer's thumb and/or in a region corresponding to an area around the intersection of the palm, and the middle, ring and little fingers. A physically perceivable signal is generated by an electrical device if one of said sensors senses an absence of pressure thereagainst. The signal is preferably an audible signal, having different characteristics for each sensor. Typically the sensors are pressure sensitive, capacitive or proximity switches. The electronic and signaling components are housed in a pocket on the back of the glove.

It is apparent that numerous innovations for golf score counters have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object the present invention is to provide a device for wearing on a hand and counting and displaying golf strokes taken per hole and per game that avoids the disadvantages of the prior art.

Another object of the present invention is to provide a device for wearing on a hand and counting and displaying golf strokes taken per hole and per game that is simple and inexpensive to manufacture.

Still another object of the present invention is to provide a device for wearing on a hand and counting and displaying golf strokes taken per hole and per game that is simple to use.

Briefly stated, still yet another object of the present invention is to provide a device that counts and displays golf strokes per hole and per game and includes a golf glove and a counter attached to the golf glove, either by hook and loop fasteners, snaps, a magnet, or a pouch. The counter includes a hole strokes digital counter and display for counting and displaying the golf strokes per hole, a total strokes digital counter and display for counting and displaying the golf strokes per game, a stroke advance button that advances the hole stroke counterand display and the total strokes digital counter and display, a clear button that clears the hole strokes digital counter and display, either an on/off button or a two second timer that allows the total strokes digital counter and display to be cleared when the clear button is depressed for two seconds, and a power source that is either a battery interface or a solar cell.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 4 is an enlarged diagrammatic side elevational view of the area generally enclosed by the dotted curve identified by arrow 4 in FIG. 1 of a second embodiment for attaching the counter portion of the present invention to the golf glove of the present invention, prior to attaching;

FIG. 5 is an enlarged diagrammatic side elevational view of the area generally enclosed by the dotted curve identified by arrow 5 in FIG. 1 of a third embodiment for attaching the counter portion of the present invention to the golf glove of the present invention, prior to attaching;

FIG. 6 is an enlarged diagrammatic side elevational view of the area generally enclosed by the, dotted curve identified by arrow 5 in FIG. 1 of a fourth embodiment for attaching the counter portion of the present invention to the golf glove of the present invention, prior to attaching;

FIG. 12 is a block diagram for operating the second and third embodiment of the counter of the counter portion of the present invention shown in FIG. 10; and FIG. 13 is a block diagram for operating the first and fourth embodiments of the counter of the counter portion of the present invention shown in FIG. 11.

LIST OF REFERENCE NUMERALS UTILIZED IN THE DRAWING

Figure 1:
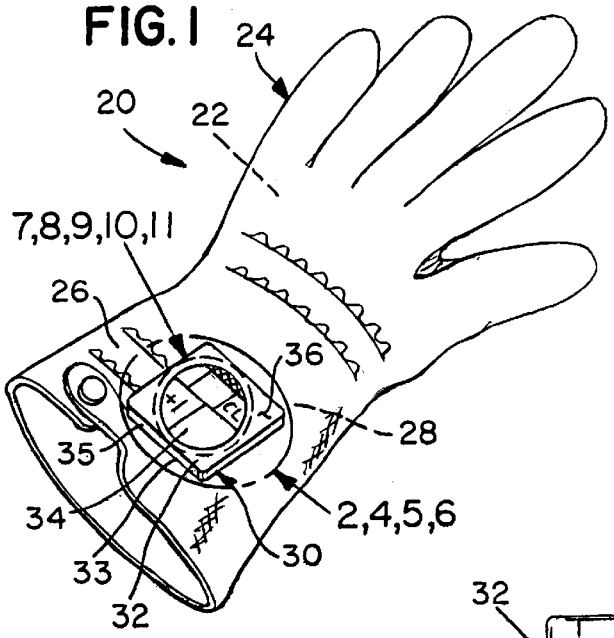
FIG. 1 is a diagrammatic perspective view of the present invention.

20 device of present invention for wearing on hand 22 and for counting and displaying golf strokes taken per hole and per game
22 hand
24 golf glove for wearing on hand 22
26 back of golf glove 24 for overlying back 28 of hand 22
28 back of hand 22
30 counter portion for counting and displaying golf strokes taken per hole and per game
32 housing of counter portion 30
33 attaching apparatus
34 electronic counter of counter portion 30 for counting and displaying golf strokes taken per hole and per game
35 glove-facing surface of housing 32 of counter portion 30

36 ambient-facing surface of housing 32 of counter portion 30

First Embodiment of Attaching Apparatus

133 attaching apparatus
138 first portion of hook and loop fasteners of attaching apparatus 133
140 second portion 140 of hook and,loop fasteners of attaching apparatus 133

Second Embodiment of Attaching Apparatus

233 attaching apparatus
238 female snap portions of attaching apparatus 233
240 male snap portions of attaching apparatus 233

Third Embodiment of Attaching Apparatus

332 housing
333 attaching apparatus
342 magnetic plate of attaching apparatus 333

Fourth Embodiment of Attaching Apparatus

432 housing
433 attaching apparatus
444 pouch
446 uppermost wall of pouch 444

First Embodiment of Electronic Counter

534 electronic counter
548 hole strokes digital counter and display of electronic counter 534 for counting and displaying golf strokes per hole
550 stroke advance button of electronic counter 534
552 total strokes digital counter and display of electronic counter 534 for counting and displaying golf strokes per game
554 clear button of electronic counter 534
556 two second timer of electronics counter 534
560 power source of electronic counter 534
565 battery interface of power source 560 of electronic counter 534

Second Embodiment of Electronic Counter

634 electronic counter
656 on/off button of electronic counter 634

Third Embodiment of Electronic Counter

734 electronic counter
760 solar cell of power source 560 of electronic counter 734

Fourth Embodiment of Electronic Counter

834 electronic counter
860 solar cell of power source 560 of electronic counter 834

DETAILED DESCRIPTION OF THE PREFERRED EMBODIMENT

Referring now to the figures, in which like numerals indicate like parts, and particularly to FIG. 1, the device of the present invention is shown generally at 20 for wearing on a hand 22 and for counting and displaying golf strokes taken per hole and per game.

The general configuration of the device 20 can best be seen in FIG. 1, and as such, will be discussed with reference thereto.

The device 20 comprises a golf glove 24 for wearing on the hand 22, and which has a back 26 for overlying the back 28 of the hand 22, and a counter portion 30 for counting and displaying the golf strokes taken per hole and per game, and which is attached to the back 26 of the golf glove 24 for giving a golfer free range of motion and not affect the swing.

The counter portion 30 comprises a housing 32 that is attached to the back 26 of the golf glove 24 by attaching apparatus 33, and an electronic counter 34 for counting and displaying the golf strokes taken per hole and per game, and which is replaceably received in the housing 32 thereof.

The housing 32 of the counter portion 30 is generally square-shaped and flat so as not to be obtrusive on the back 26 of the golf glove 24, and has a glove-facing surface 35 that abuts completely against the back 26 of the golf glove 24, and an ambient-facing surface 36 that is disposed oppositely to the glove-facing surface 35 thereof.

The electronic counter 34 of the counter portion 30 is circular-shaped and visible from the ambient-facing surface 36 of the housing 32 of the counter portion 30.

The electronic counter 34 of the counter portion 30 is recessed in, and flush with, so as not to obtruded past, the ambient-facing surface 36 of the housing 32 of the counter portion 30 so as to prevent damage thereto during play.

Figure 3:
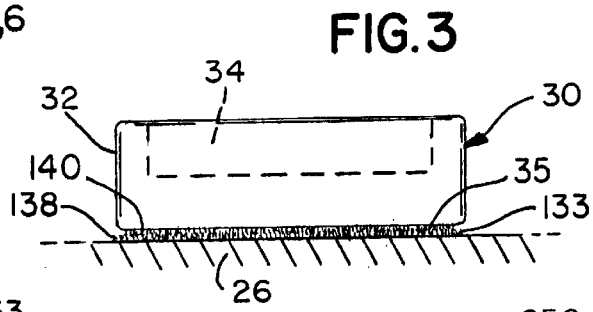
FIG. 3 is an enlarged diagrammatic side elevational view of the first embodiment for attaching the counter portion of the present invention to the golf glove of the present invention shown in FIG. 2, subsequent to attaching.
Figure 2:
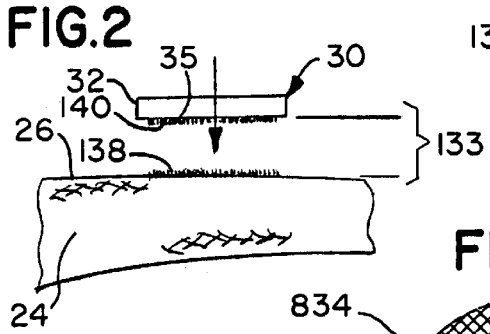
FIG. 2 is a diagrammatic side elevational view of the area generally enclosed by the dotted curve identified by arrow 2 in FIG. 1 of a first embodiment for attaching the counter portion of the present invention to the golf glove of the present invention, prior to attaching.

The specific configuration of a first embodiment of the attaching apparatus 133 can best be seen in FIGS. 2 and 3, and as such, will be discussed with reference thereto.

The attaching apparatus 133 comprises a first portion 138 of hook and loop fasteners that are disposed on the back 26 of the golf glove 24, and a second portion 140 of the hook and loop fasteners that are disposed on the glove-facing surface 35 of the housing 32, and which selectively mate with the first portion 138 of hook and loop fasteners.

The specific configuration of a second embodiment of the attaching apparatus 233 can best be seen in FIG. 4, and as such, will be discussed with reference thereto.

The attaching apparatus 233 comprises female snap portions 238 that are disposed on the back 26 of the golf glove 24, and male snap portions 240 that are disposed on the glove-facing surface 35 of the housing 32, and which selectively snap with, the female snap portions 238, respectively.

The female snap portions 238 are disposed on the back 26 of the golf glove 24 so as eliminate obtrusions when the housing 32 is removed which would be caused had the male snap portions 240 been disposed thereon.

The specific configuration of a third embodiment of the attaching apparatus 333 can best be seen in FIG. 5, and as, such, will be discussed with reference thereto.

The attaching apparatus 333 comprises a magnetic plate 342 that is disposed on the back 26 of the golf glove 24, and the housing 332 is made from a material that is magnetically attractive to the magnetic plate 342 so as to be selectively attached thereto.

The specific configuration of a fourth embodiment of the attaching apparatus 433 can best be seen in FIG. 6, and as such, will be discussed with reference thereto.

The attaching apparatus 433 comprises the housing 432 being a pouch 444 that is attached to the back 26 of the golf glove 24, and which has a uppermost wall 446 that is opened so as to allow the electronic counter 34 to be inserted and selectively held therein.

Figure 8:
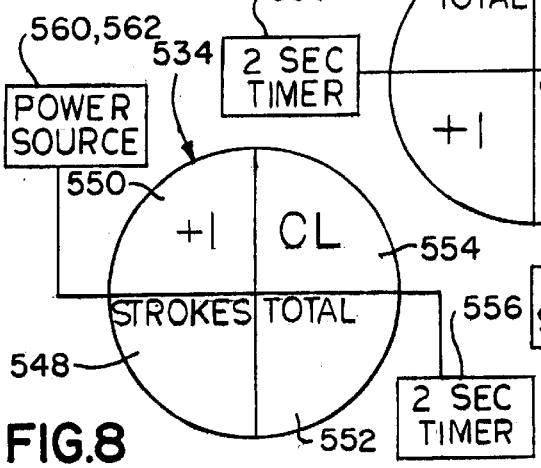
FIG. 8 is an enlarged diagrammatic top plan view of the area generally enclosed by the dotted curve identified by arrow 8 in FIG. 1 of a second embodiment of the counter of the counter portion of the present invention.
Figure 7:
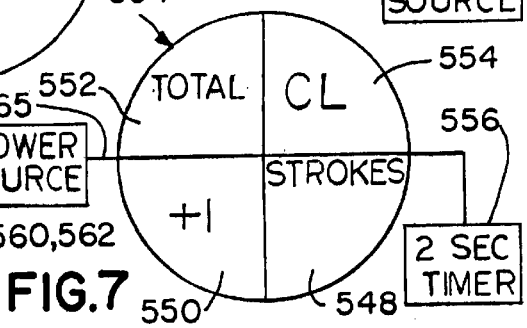
FIG. 7 is an enlarged diagrammatic top plan view of the area generally enclosed by the dotted curve identified by arrow 7 in FIG. 1 of a first embodiment of the counter of the counter portion of the present invention.

The specific configuration of a first embodiment of the electronic counter 534 can best be seen in FIGS. 7, 8, and 13, and as such, will be discussed with reference thereto.

The electronic counter 534 comprises a hole strokes digital counter and display 548 for counting and displaying the golf strokes per hole.

The electronic counter 534 further comprises a stroke advance button 550, that when depressed, advances the hole stroke counter and display 548.

The electronic counter 534 further comprises a total strokes digital counter and display 552 for counting and displaying the golf strokes per game, and which advances automatically each time the stroke advance button 550 is depressed.

The electronic counter 534 further comprises a clear button 554, that when depressed momentarily, clears the hole strokes digital counter and display 548, but not the total strokes digital counterand display 552 so as to allow initializing of the hole strokes digital counter and display 548 for the next hole without effecting the total strokes digital counter and display 552 for the game.

The electronic counter 534 further comprises a two second timer 556 that allows the total strokes digital counter and display 552 to be cleared when the clear button 554 is depressed for two seconds.

The electronic counter 534 further comprises a power source 560 that is contained therein.

The power source 560 is a battery interface 562.

Figure 9:
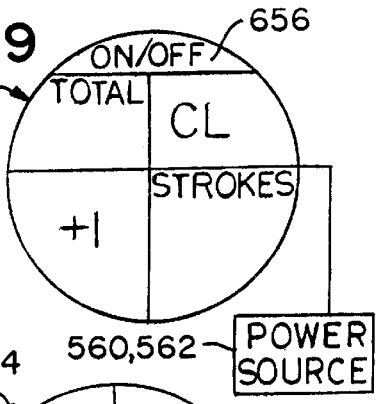
FIG. 9 is an enlarged diagrammatic top plan view of the area generally enclosed by the dotted curve identified by arrow 9 in FIG. 1 of a third embodiment of the counter of the counter portion of the present invention.

The specific configuration of a second embodiment of the electronic counter 634 can best be seen in FIGS. 9 and 12, and as such, will be discussed with reference thereto.

The electronic counter 634 is similar to the electronic counter 534, but with the two second timer 556 being replaced with an on/off button 656 that shuts the electronic counter 634 on and off.

Figure 10:
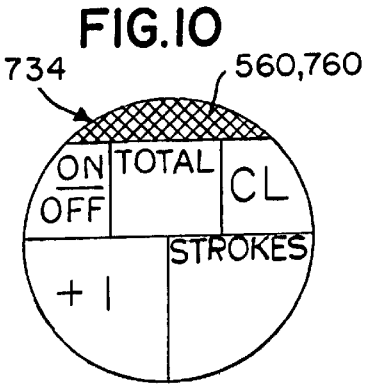
FIG. 10 is an enlarged diagrammatic top plan view of the area generally enclosed by the dotted curve identified by arrow 10 in FIG. 1 of a fourth embodiment of the counter of the counter portion of the present invention.

The specific configuration of a third embodiment of the electronic counter 734 can best be seen in FIGS. 10 and 12, and as such, will be discussed with reference thereto.

The electronic counter 734 is similar to the electronic counter 634, but with the power source 560 being a'solar cell 760.

Figure 11:
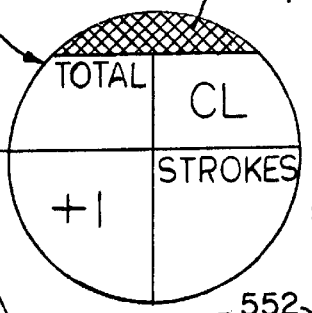
FIG. 11 is an enlarged diagrammatic top plan view of the area generally enclosed by the dotted curve identified by arrow 11 in FIG. 1 of a fifth embodiment of the counter of the counter portion of the present invention.

The specific configuration of a fourth embodiment of the electronic counter 834 can best be seen in FIGS. 11 and 13, and as such, will be discussed with reference thereto.

The electronic counter 834 is similar to the electronic counter 534, but with the power source 560 being a solar cell 860.

It will be understood that each of the elements described above, or two or more together, may also find a useful application in other types of constructions differing from the types described above.

While the invention has been illustrated and described as embodied in a device for wearing on a hand and counting and displaying golf strokes taken per hole and per game, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A device for wearing on a hand for counting and displaying golf strokes taken per hole and per game, comprising:

a) a golf glove for wearing on the hand, and having a back for overlying the back of the hand; and b) an electronic counter of a counter portion for counting and displaying the golf strokes taken per hole and per game, and being attached to said back of said golf glove for giving a golfer free range of motion and not affect a swing, wherein said counter portion further comprises a housing that is attached to said back of said golf glove by attaching apparatus and said electronic counter is replaceably received in said housing, wherein said electronic counter comprises a hole strokes digital counter and display for counting and displaying said golf strokes per hole, wherein said electronic counter further comprises a stroke advance button, that when depressed, advances said hole stroke counter and display, wherein said electronic counter further comprises a total strokes digital counter and display for counting and displaying the golf strokes per game, and which advances automatically each time said stroke advance button is depressed, wherein said electronic counter further comprises a clear button, that when depressed, clears said hole strokes digital counter and display, but not said total strokes digital counter and display so as to allow initializing of said hole strokes digital counter and display for the next hole without effecting said total strokes digital counter and display for the game.

2. The device as defined in claim 1, wherein said housing of said counter portion is generally square-shaped and flat so as not to be obtrusive on said back of said golf glove, and has:

a) a glove-facing surface that abuts completely against said back of said golf glove; and b) an ambient-facing surface that is disposed oppositely to said glove-facing surface thereof.

3. The device as defined in claim 2, wherein said electronic counter of said counter portion is circular-shaped and visible from said ambient-facing surface of said housing of said counter portion.

4. The device as defined in claim 2, wherein said electronic counter of said counter portion is recessed in, and flush with, so as not to obtruded past, said ambient-facing surface of said housing of said counter portion so as to prevent damage thereto during play.

5. The device as defined in claim 2, wherein said attaching apparatus comprises:

a) a first portion of hook and loop fasteners that are disposed on said back of said golf glove; and b) a second portion of said hook and loop fasteners that are disposed on said glove-facing surface of said housing, and which selectively mate with said first portion of hook and loop fasteners.

6. The device as defined in claim 2, wherein said attaching apparatus comprises:

a) female snap portions that are disposed on said back of said golf glove; and b) male snap portions that are disposed on said glove-facing surface of said housing, and which selectively snap with said female snap portions, respectively.

7. The device as defined in claim 6, wherein said female snap portions are disposed, on said back of said golf glove so as eliminate obtrusions when said housing is removed which would be caused had said male snap portions been disposed thereon.

8. The device as defined in claim 2, wherein said attaching apparatus comprises:

a) a magnetic plate that is disposed on said back of said golf glove; and b) said housing being made from a material that is magnetically attractive to said magnetic plate so as to be selectively attached thereto.

9. The device as defined in claim 2, wherein said attaching apparatus comprises said housing being a pouch that is attached to said back of said golf glove, and which has an uppermost wall that is opened so as to allow said electronic counter to be inserted and selectively held therein.

10. The device as defined in claim 1, wherein said electronic counter further comprises a power source contained therein that powers said electronic counter.

11. The device as defined in claim 10, wherein said electronic counter further comprises a two second timer that allows said total strokes digital counter and display to be cleared when said clear button is depressed for two seconds.

12. The device as defined in claim 11, wherein said power source is a battery interface.

13. The device as defined in claim 11, wherein said power source is a solar cell.

14. The device as defined in claim 10, wherein said electronic counter further comprises an on/off button, that shuts said electronic counter on and off.

15. The device as defined in claim 14, wherein said power source is a battery interface.

16. The device as defined in claim 14, wherein said power source is a solar cell.

* * * * *